United States Patent [19]

Rasmussen

[11] Patent Number: 4,756,523

[45] Date of Patent: Jul. 12, 1988

[54] EXERCISE ROWING MACHINE WITH SEAT CARRIAGE LOCK

[75] Inventor: Robert A. Rasmussen, Redmond, Wash.

[73] Assignee: M & R Industries, Inc., Redmond, Wash.

[21] Appl. No.: 882,079

[22] Filed: Jul. 3, 1986

[51] Int. Cl.[4] ..... A63B 21/00

[52] U.S. Cl. ..... 272/72; 272/144; 188/67

[58] Field of Search ..... 272/69, 70, 97, 72, 272/144; 188/41–43, 67; 292/257, 258, 140, 159

[56] References Cited

U.S. PATENT DOCUMENTS

| | | | |
|---|---|---|---|
| 1,920,574 | 8/1933 | Luzzi | 272/72 |
| 2,982,574 | 5/1961 | Von Sternberg | 292/159 |
| 4,541,627 | 9/1985 | MacLean | 272/72 |
| 4,650,197 | 3/1987 | Norris | 188/42 |
| 4,653,749 | 3/1987 | Rorabaugh | 272/97 |

*Primary Examiner*—Richard J. Apley
*Assistant Examiner*—S. R. Crow
*Attorney, Agent, or Firm*—Seed and Berry

[57] ABSTRACT

An exercise rowing machine of the type having a seat carriage movable along a track unit as the exerciser manipulates pivoted rowing arms in performing a standard rowing exercise is provided with a brake assembly on the seat carriage having a brake pad which can be selectively moved into and out of frictional braking engagement with the track unit to lock the seat carriage so that alternative exercises can be performed on the machine.

6 Claims, 2 Drawing Sheets

EXERCISE ROWING MACHINE WITH SEAT CARRIAGE LOCK

DESCRIPTION

1. Technical Field

The present invention relates to exercise rowing machines of the type in which a seat carriage rolls back and forth along a pair of tracks as the exerciser pushes back on his legs and pulls back rowing arms to overcome a resisting load exerted, for example, by cylinder units extending between the rowing arms and an underlying support frame providing the tracks. More particularly, the invention is directed to a mechanism for locking the seat carriage to the frame in selected positions along the track rails.

2. Background Art

Heretofore, the seat carriages of rowing machines have been free to roll back and forth along the related support frame as the rowing exercise was being performed. It has been determined that other worthwhile exercises can be performed if the seat carriage can be locked relative to the support frame at selected positions. This is accomplished by the present invention.

3. Disclosure of the Invention

For purposes of example, the invention is shown as applied to an exercise rowing machine like that shown in prior U.S. Pat. No. 4,541,627, issued Sept. 17, 1985, which is a type in which two parallel seat carriage tracks are provided by a single, central, longitudinal frame member which may be an aluminum extrusion. In such a device, a pair of rollers are provided on each side of a seat carriage and they track on lower flanges while being retained by overlying upper flanges. The latter, together with the track flanges, form a pair of outwardly facing channels into which the seat carriage rollers project from depending side plates of a seat-carrying frame.

In accordance with the present invention, the underside of one of the retainer flanges serves as the stop face for an elastomeric brake pad which is carried by a swing arm pivotally connected to a control handle. This control handle rotates one of the side plates of the carriage frame and has a projecting eccentric pin which interfits with a slot in the swing arm so that turning of the control handle raises and lowers the brake pad into and out of locking engagement with the stop face. The swing arm is preferably journaled on the axle for one of the seat carriage rollers.

BEST MODE FOR CARRYING OUT THE INVENTION

Figure 1:
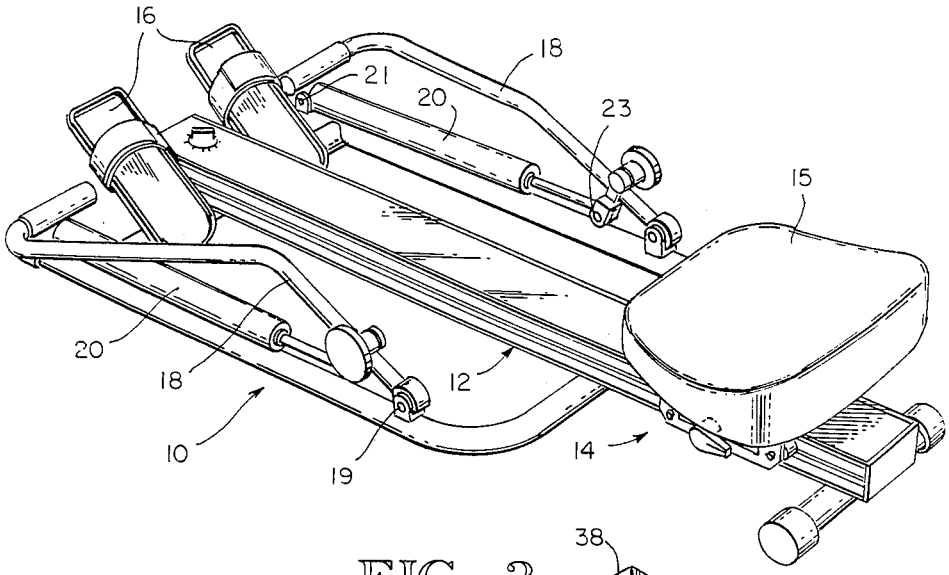
FIG. 1 is a perspective view of an exercise rowing machine embodying the present invention.

As previously indicated, the seat locking mechanism of the present invention can be applied to exercise rowing machines of the type shown in U.S. Pat. No. 4,541,627; and for purposes of example, such a rowing machine has been illustrated in the drawings (FIG. 1). This machine has a frame 10 including a center longitudinal rail 12, a seat carriage 14 for a seat 15, a pair of foot plates 16 pivotally mounted to the frame assembly, a pair of rowing arms 18 swing-mounted at 19 at opposite sides of the frame assembly, and cylinder units 20 pivotally mounted at 21 to the frame assembly and to the rowing arms at 23 for resisting swinging movement thereof. The frame assembly and rowing arms 18 may be fabricated from tubular stock. The rowing arms are provided with an adjustment to vary the location of the pivotal connection of the cylinder units 20 to the rowing arms 18.

The center rail 12 is preferably an aluminum extrusion having a generally rectangular configuration in cross section, but with the top walls thereof extending laterally beyond the side walls thereof to provide top and bottom and bottom lateral flange extensions 24, 25 at both sides. This arrangement gives side channels to receive sets of seat carriage rollers, two rollers 26, 27 per set. These rollers are mounted on opposite sides of a seat carriage frame 28, having an inverted U-shape providing depending side plates **28*c*. The seat 15 has a wooden base mounted on the center web 28*a* of the frame 28 by screws passing upwardly through holes 28*b* in the web 28*a*. It is preferred that the rollers 26, 27 have convex rims and that one or both of the opposed faces of the flanges 24, 25 be concave so as to mate with the rollers and keep them in proper alignment. The upper flange 24 has a retaining function, and the lower flange 25** has a track function.

The rollers 26, 27 each have a roller bearing unit 30 with its inner race mounted on a cap screw 32 which passes through one of the side plates **28*c* and has a stepped spacer 33 located between the seat frame and the bearing 30. A lock nut 32*a* is provided on the inner end of each cap screw 32 to bear against the inner race of the respective bearing 30** and keep the rollers in position.

In accordance with the present invention, the seat carriage 14 is provided with a locking mechanism which is operated by turning a control handle extension 35 of a hollow knob 34. This knob 34 cooperates with a swing arm 36 to move an elastomeric brake pad 38 into and out of engagement with the underface of the retaining flange 24 at one side of the center rail 12. In the illustrated embodiment, the locking mechanism has been shown on the left-hand side of the center rail when facing forwardly toward the foot plates 16. For purposes of example, the locking mechanism has been arranged so that the control handle 35 faces rearwardly when the locking mechanism is in its locked position and faces forwardly when the locking mechanism is in its locked position. A decal 37 may be provided indicating by "lock" and "slide" notations the correct handle positions corresponding to locked and released seat carriage conditions, respectively.

Figure 6:
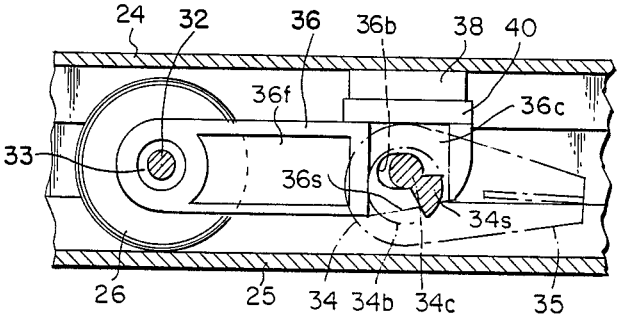
FIG. 6 is a longitudinal sectional view taken as indicated by line 6—6 in FIG. 5.
Figure 7:
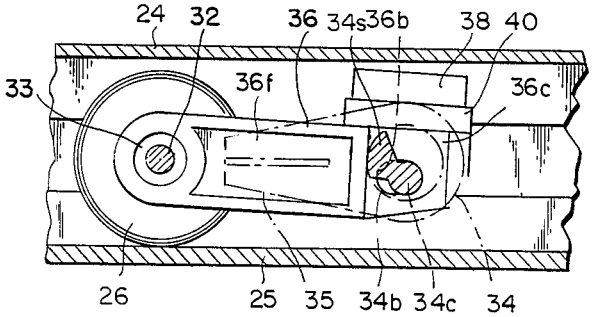
FIG. 7 is taken in the same manner as FIG. 6 and shows the locking mechanism in released position.

The swing arm 36 has a forward through-opening 36*a* to receive the spacer 33 on the forward roller 26 on the corresponding side of the seat carriage and extends rearwardly to make a sliding and pivotal connection with the knob 34. Swing arm 36 also has an upwardly facing rectangular pocket 40 for the brake pad 38 whose upper rim is generally parallel to the retaining flange 24 when the control handle 35 is in a rearwardly directed position. The brake pad has a flat upper face which bears along its length against the locking underface of the retaining flange 24 when compressed in locking position (FIG. 6). when in unlocked position (FIG. 7), the brake pad 38 tilts down to the rear and is out of engagement with the retaining flange 24.

Figure 3:
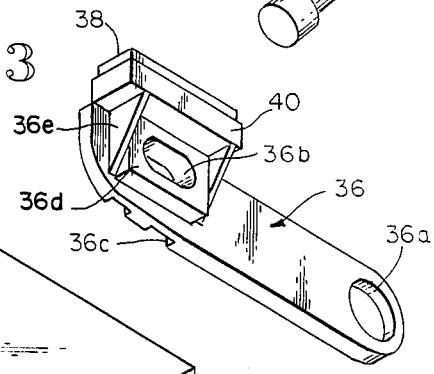
FIG. 3 is a perspective view of the swing arm as seen from the back side.
Figure 2:
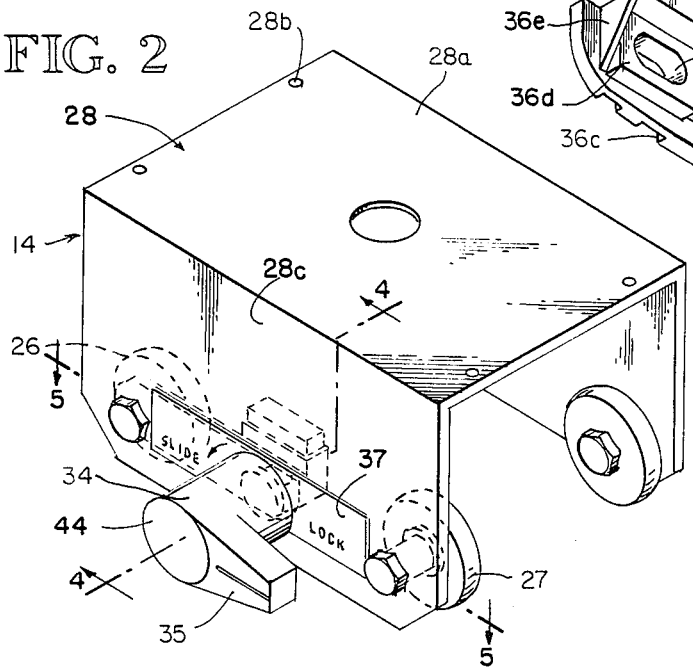
FIG. 2 is an enlarged perspective view of the seat carriage with the seat removed and the seat locking mechanism in locked position.
Figure 4:
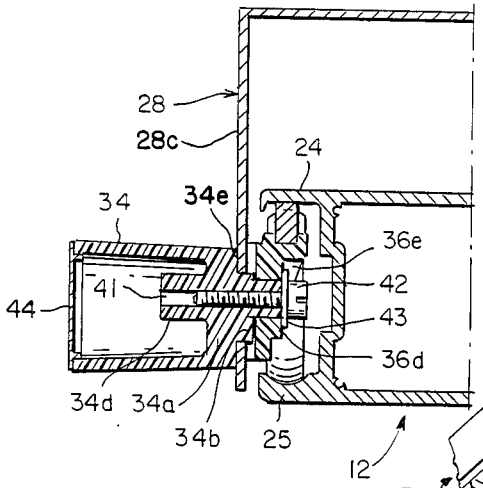
FIG. 4 is a fragmentary, transverse, vertical cross-sectional view taken as indicated by line 4—4 in FIG. 2.

The locking knob 34 has an inner circular wall 34*a* from which a concentric boss 34*b* projects at a step face 34*e* to pivotally interfit with a hole 28*c* in the carriage frame 28. The boss 34*b* has an eccentric pin extension 34*c* which projects into a slot 36*b* in the swing arm 36 having semicircular ends connected by relatively short, straight sections. As best seen in FIG. 3, the back side of the swing arm 36 facing the center rail 12 has a thickened rectangular boss portion 36*d* through which the slot 36*b* passes and has a pair of triangular reinforcing gussets extending downwardly from the underside of the pocket 40. At its opposite side, the swing arm 36 may be centrally recessed at 36*f* to save material and has a rectangular recess 36*c* to accommodate the inner portion of the boss 34*b*, which essentially functions as a crank or link between the swing axis of the handle 35 and the pivot axis of the pin extension 34*c*. When the stop mechanism is assembled, the step face 34*e* on the back of the knob 34 engages the outer face of the side plate 28*c* of the seat carriage frame 28, and the outer face of the swing arm 36 engages the inner face of the side plate 28*c*. This arrangement provides a preferred frictional resistance to swing movement of the handle 35 and swing arm 36. A self-tapping screw 42 is screwed into a bore 41 passing through the pin extension 34*c*, boss 34*b*, inner wall 34*a*, and an inner extension 34*d*, and holds a washer 43 against the exposed face of the swing arm at the rim of the slot 36*b* to hold the eccentric pin 34*c* in pivotal relation to the swing arm 36.

In both the extreme locked and released positions of the brake pad 38, the pin extension 34*c* occupies the rear end portion of the slot 36*b*. Interference between the pin extension 34*c* and the rear end portion of the slot is preferred when the longitudinal axis of the handle 35 is generally on a line through the rotary axes of the wheels 26–27. Engagement of the brake pad 28 with the underface of the overlying retaining flange 24 commences before the pin extension 34*c* reaches its rear limit of travel so that the brake pad will be compressed when the handle 35 is in its locked position.

Figure 8:
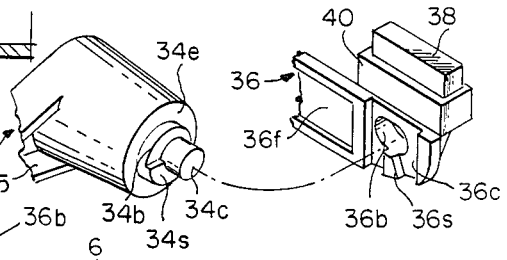
FIG. 8 is an exploded fragmentary perspective view showing the rear portion of the swing arm as viewed from the front, and showing the rear cooperative portion of the knob.
Figure 5:
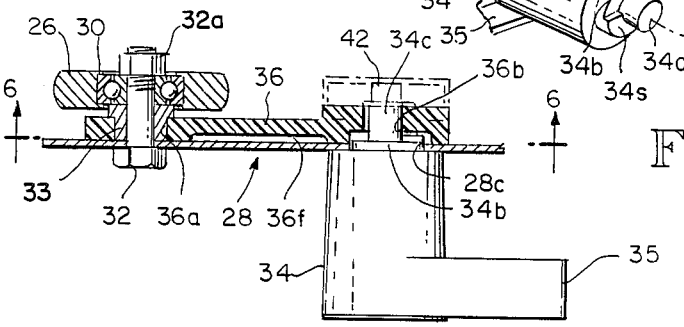
FIG. 5 is a fragmentary, longitudinal, horizontal sectional view taken along the line 5—5 of FIG. 2.

In moving the brake pad 38 between its raised locking position and lowered released positioned, it is preferred to have the handle 35 swing upwardly and slightly less than 180 degrees between its rearwardly and forwardly directed positions and to have the pin extension 34*c* not reach the extreme rear end of the slot 36*b* before there is interference in the slot 36*b* between the pin extension 34*c* and the swing arm 36. In this regard, as best seen in FIG. 8, to give a more positive feel to the locked position, it is preferred to provide the boss 34*b* of the knob 34 and the recessed portion 36*c* of the swing arm 36 with cooperating stop segments 34*s*, 36*s* which engage when the knob 34 reaches its locked position.

The indicated design of the locking handle unit and swing arm is such that they may be easily injection molded from plastic, such as nylon. Assembly of the locking unit is simple since it only involves placement of the swing arm 36 in the forward carriage roller assembly location and introduction of the self-tapping screw 42 after the knob 34 has been positioned with its boss 34*b* extending through the side plate 28*c* of the carriage bracket and the eccentric pin extension 34*c* positioned in the slot 36*b* at the rear end of the swing link 36. The brake pad 38 is preferably anchored in the pocket 40 of the swing arm by a suitable adhesive, and its material may be 70 to 80 durometer neoprene. A snap-on cover 44 may be applied to close the open outer end of the knob 34.

It will be apparent that the seat carriage can be locked in a desire position along the center rail member 12 by manipulation of the control handle 35 or can be left in free-rolling condition when the device is being used primarily as a rowing machine. Various exercises can be performed with the seat carriage locked to the frame at various positions along the center rail.

Although, in the preferred embodiment, the two tracks of the seat carriage have been provided by a single central frame member, it will be appreciated that this is not essential for the invention and that the two rails can be provided with separate longitudinal members.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An exercise device comprising:

an exercise rowing machine of the type having a frame providing a track unit with a retaining face therealong, a seat carriage movable along said track unit and having an axle and a roller mounted on the axle to roll along the track unit below said retaining face, and rowing arms pivotally connected to said frame;

brake means including a brake pad and mounted on said seat carriage for frictionally engaging said brake pad with said retaining face to selectively lock said seat carriage from movement relative to said frame, said brake means also includes a swing arm carrying said brake pad and pivotally mounted on said axle for movement toward and away from said retaining face; and a control unit pivotally mounted on the seat carriage and having a pin and slot connection with said swing arm for swinging said swing arm responsive to turning of the control unit.

2. An exercise rowing machine comprising:

a frame assembly including a pair of oppositely facing track channels presenting a pair of parallel longitudinal track faces and a pair of parallel retaining faces, said track faces and retaining faces being directed oppositely;

a seat carriage having a seat support frame, and having two pairs of rollers which are journal-mounted on the seat support frame and are arranged to roll along the track faces and be restricted from movement away from the track faces by the retaining faces;

seat locking means including a pressure pad and mounted on the seat support frame for movement between a carriage locking position whereat the pressure pad engages one of said retaining faces and a carriage released position whereat the pressure pad is disengaged from such retaining face, said seat locking means also including a swing arm pivotally connected at one of its ends to the carriage and carrying said pressure pad; and arm swinging means pivotally mounted on the carriage and pivotally connected at the other end of the swing arm, the pivotal connection at one end of the swing arm comprising a sliding pivot; and rowing arm means mounted on said frame assembly.

3. In an exercise rowing machine:

a frame including a longitudinal rail member formed along its length with a top wall, a pair of sidewalls at opposite sides of the top wall, a pair of track flanges at opposite sides, and a pair of retaining flanges at opposite sides;

a seat carriage having a seat support frame straddling the rail member and supported by two pairs of rollers tracking on the track flanges and underlying the retaining flanges; and locking means including a brake pad and mounted on the seat support frame for selectively locking the seat carriage relative to said rail member by frictionally engaging the brake pad with one of said retaining flanges and forcing a respective one of said pairs of rollers against the underlying track flange, said locking means also including a swing arm pivotally mounted on said seat support frame opposite the space between said one retaining flange and the underlying track flange and carrying said brake pad; and a control lever pivotally mounted on the support frame on a pivot axis and having a pivot pin interfitting with a slot in the swing arm, said pivot pin being offset from said pivot axis whereby turning of the control lever in one direction forces the brake pad against said one retaining flange and turning of the control lever in the opposite swing direction releases the brake pad.

4. In an exercise rowing machine:

a seat carriage frame having an axle with a roller journal-mounted thereon for rolling along a track;

a swing arm pivotally mounted at one end on said axle and having a brake pad near its opposite end for selectively engaging a retaining face spaced from the track;

a control element journaled in said frame for turning about a turn axis between an unlocked position and a locked position whereat the brake pad engages the retaining face; and a pivot pin projecting from said control element through a longitudinal slot in said swing arm adjacent said brake pad and having a pivot axis offset from said turn axis whereby turning of the control element responsively swings the swing arm and moves the brake pad into engagement and out of engagement with the retaining face, the turning of the control element being limited to approximately a half turn.

5. In an exercise rowing machine according to claim 4 in which said control element has a first projecting stop element alongside said pin, and in which said swing arm has a second projecting stop element arranged to be engaged by the first projecting stop element when said control element is in its locked position.

6. An exercise machine comprising:

a frame assembly including a longitudinal rail member formed along its length with a top wall extending across its width, a pair of lateral side walls depending from the top wall at locations spaced inwardly from the outer longitudinal side edges of the top wall, and a pair of track flanges extending outwardly from said side walls in opposite directions and spaced beneath said top wall;

an exercise element pivotally mounted on said frame assembly;

a seat carriage having a seat support frame straddling said rail member and supported by two pairs of rollers tracking on the track flanges and underlying said top wall;

a swing arm pivotably mounted adjacent to one of its ends on said carriage for movement of its other end toward and away from said top wall;

a locking means comprising a brake shoe facing toward said top wall and mounted on said seeing arm adjacent said other end thereof;

a control member mounted for turning movement on a lateral side of said carriage and having a crank element thereof slidably engaging said swing arm whereby turning of the control lever in one direction results in pivoting of the swing arm such as to responsively force said brake shoe firmly into engagement with said top wall and force one of said rollers firmly against the underlying track flange, and whereby turning of the control lever in the opposite direction results in disengagement of the brake shoe with said top wall and freeing of said one roller for rolling along the respective track flange.

* * * * *

UNITED STATES PATENT AND TRADEMARK OFFICE

CERTIFICATE OF CORRECTION

PATENT NO. : 4,756,523

DATED : July 12, 1988

INVENTOR(S) : Robert A. Rasmussen

It is certified that error appears in the above-identified patent and that said Letters Patent is hereby corrected as shown below:

Claim 6, line 37, delete "seeing" and substitute therefor --swing--.

Signed and Sealed this

Fourteenth Day of March, 1989

*Attest:*

DONALD J. QUIGG

*Attesting Officer*

*Commissioner of Patents and Trademarks*